United States Patent [19]

Blessing

[11] 4,204,492

[45] May 27, 1980

[54] APPARATUS FOR HEMMING FABRIC PIECES

[75] Inventor: Hubert Blessing, Dallas, Tex.

[73] Assignee: Levi Strauss & Co., San Francisco, Calif.

[21] Appl. No.: 925,403

[22] Filed: Jul. 17, 1978

[51] Int. Cl.[2] ..... D05B 33/00; D05B 81/00

[52] U.S. Cl. ..... 112/121.29; 112/121.12

[58] Field of Search ..... 112/121.29, 121.11, 112/121.12, 121.15

[56] References Cited

U.S. PATENT DOCUMENTS

| | | | |
|---|---|---|---|
| 3,126,848 | 3/1964 | Gastonguay | 112/121.29 |
| 3,328,378 | 9/1970 | Westhoff et al. | 112/121.15 |
| 3,481,292 | 12/1969 | Danahy | 112/121.15 |
| 3,669,443 | 6/1972 | Noiles | 112/121.11 |
| 3,712,250 | 1/1973 | Striegler et al. | 112/288 |
| 3,749,040 | 7/1973 | Jurgens | 112/287 |
| 3,789,781 | 2/1974 | Carson et al. | 112/121.29 |

*Primary Examiner*—Ronald Feldbaum

*Attorney, Agent, or Firm*—Limbach, Limbach & Sutton

[57] ABSTRACT

Apparatus is disclosed for hemming successive pieces of fabric as they are moved past a sewing machine by a transport then clipping the stitching chain between pieces and removing each hemmed fabric piece from the stitching path and transporting it to a receiving position.

4 Claims, 6 Drawing Figures

APPARATUS FOR HEMMING FABRIC PIECES

BACKGROUND OF THE INVENTION

This invention relates generally to apparatus for automatic sewing of fabric pieces, and more particularly to automated apparatus for rapidly hemming successive pieces of fabric.

Apparatus is known for mechanically conveying fabric pieces to a sewing machine for stitching. Additionally, it is known to use a curved element for folding the edge of a piece of fabric passed along a stitching path to form a hem to be stitched by the sewing machine. However, while the sewing machines have been capable of very high rates of throughput, the overall performance of such assembly operations has been compromised by the inability of the apparatus to combine effectively the stitching operation, severing of the stitched chain or chains linking successive pieces of fabric and the stacking of the stitched and separated pieces of fabric for subsequent use. This problem has resulted largely from the lack of an integrated system incorporating not only the stitching and transport apparatus and thread clipping mechanism, but also a finished piece removal and stacking apparatus.

It is a principal object of the present invention to provide apparatus which incorporate into an operable unit all of the necessary functions of workpiece transport, edge folding, stitching, stitch chain severing, and workpiece removal and stacking in order to provide an efficient apparatus for hemming short pieces in garment manufacture.

SUMMARY OF THE INVENTION

The foregoing and additional objects are accomplished by the structure of hemming apparatus which comprises in combination fabric hemming means for folding and stitching a hem as the fabric is transported along a stitching path, a thread cutter positioned along the stitching path subsequent to the stitching mechanism for mechanically severing the stitching chain between successive fabric pieces, and means for removing each hemmed fabric piece from the stitching path after stitch chain severing and transporting the fabric piece to a receiving position. The hemming means include means for folding an edge of each fabric piece to form a hem and a sewing machine for stitching the hem, with the stitching forming a stitching chain between successive fabric pieces, and means spaced from the stitching path for grippingly engaging a portion of the fabric piece spaced from the hem and moving the fabric piece continuously along the path extending generally parallel to the stitching path from a point ahead of the stitching mechanism to a point beyond the stitching mechanism. Through the combination of these various components of apparatus, a very high rate of throughput of completed fabric pieces may be achieved.

Additional objects, advantages and features of the present invention are explained as part of the following detailed description.

BRIEF DESCRIPTION OF THE DRAWING

A particularly preferred embodiment of the invention is described in detail below in conjunction with the illustrations in which.

DESCRIPTION OF A PREFERRED EMBODIMENT

Figure 1:
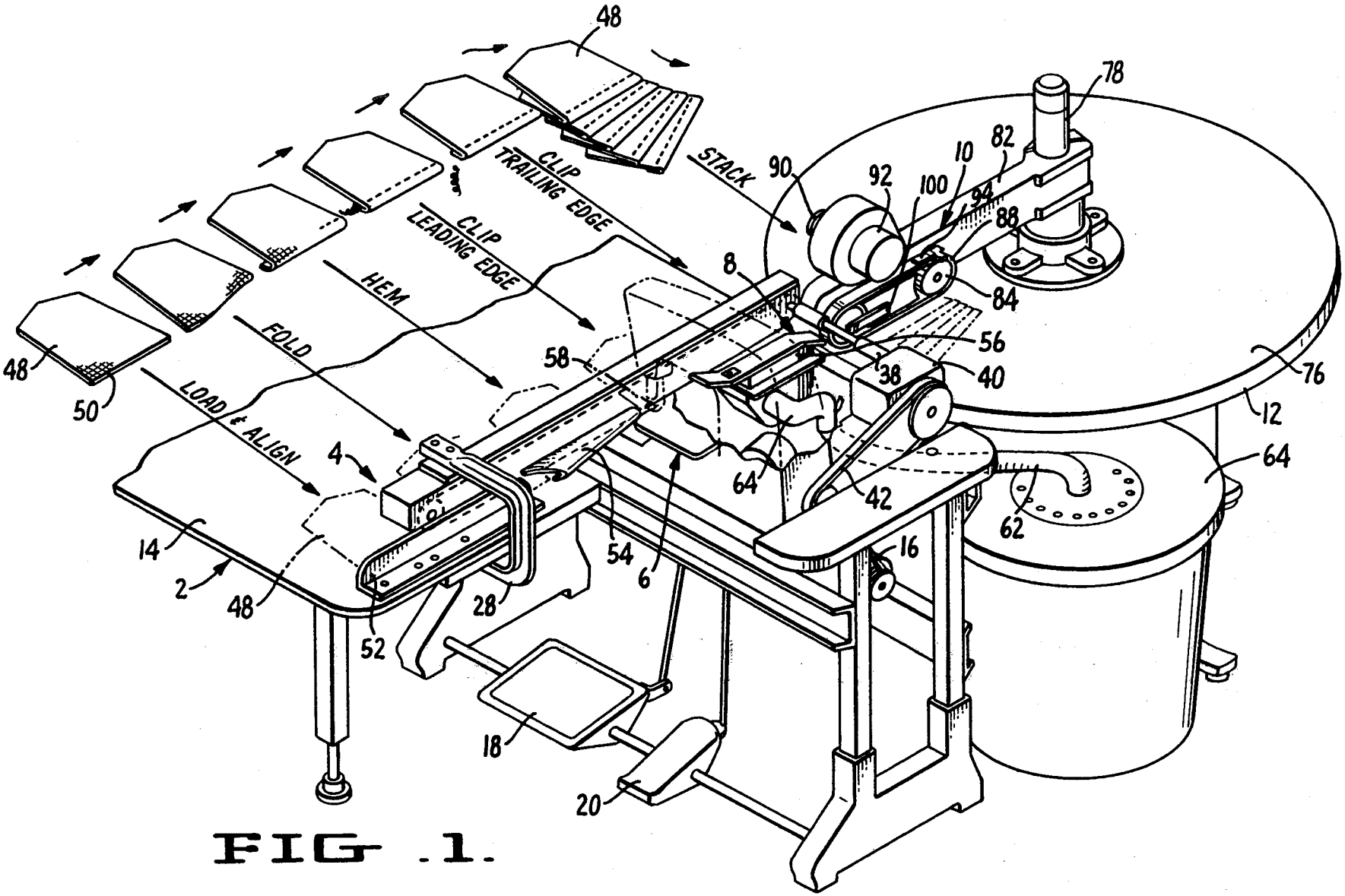
FIG. 1 is a perspective view, partially in section, of the apparatus of this invention, illustrating the steps being performed during the travel of a workpiece therethrough.
Figures 2, 3, 4:
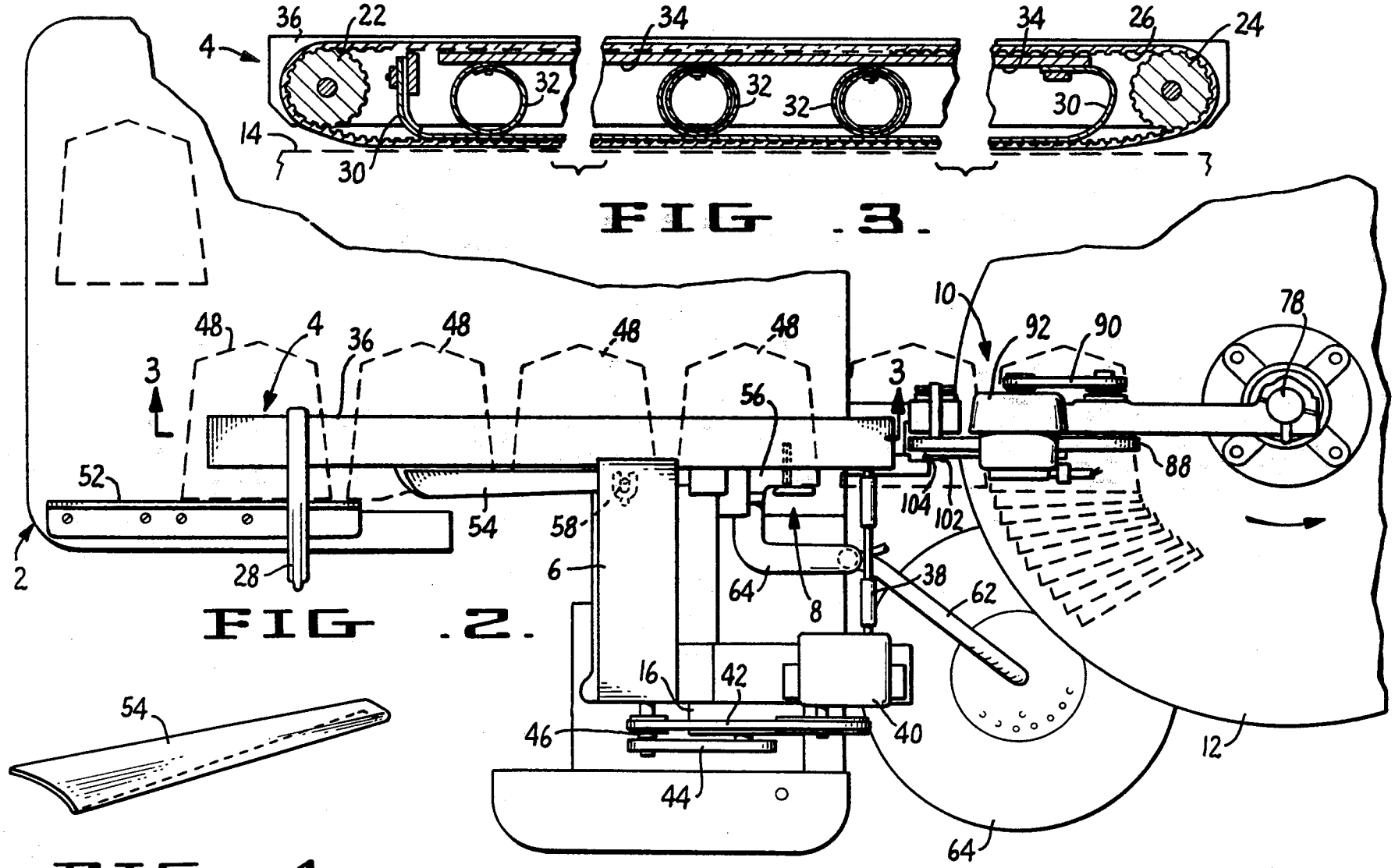
FIG. 2 is a partial planned view of the principal components of the apparatus of FIG. 1.
FIG. 3 is a side-sectional view workpiece conveying structure of FIG. 2, taken along line 3—3.
FIG. 4 is a perspective view of the edge folding device of FIG. 2.
Figure 5:
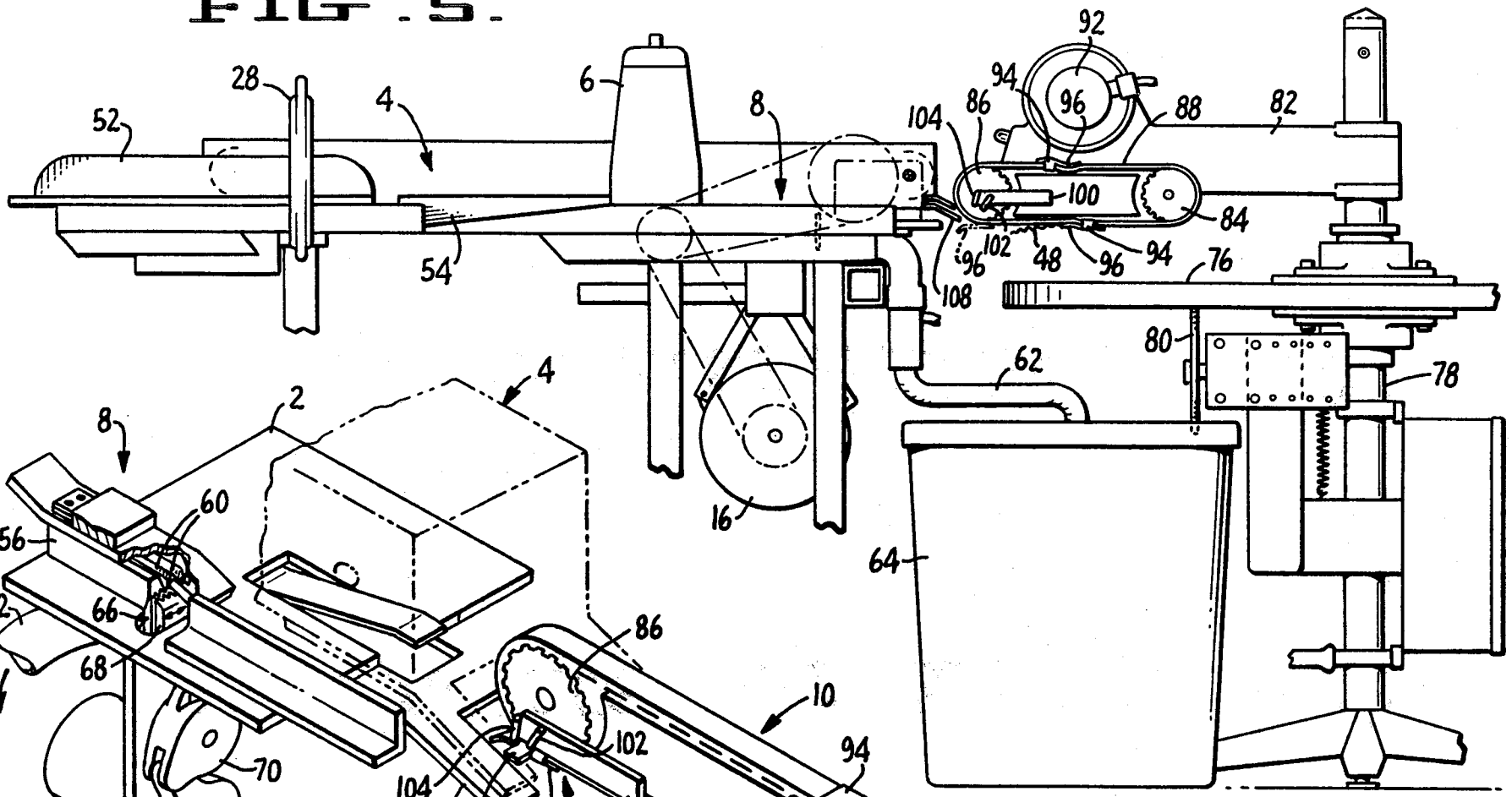
FIG. 5 is a side elevation of the apparatus of FIG. 1.

The principal elements of the apparatus of this invention are shown in the perspective, plan and elevational views of FIGS. 1, 2 and 5, respectively. The principal components comprise, generally, the workpiece supporting table 2, workpiece conveyor 4 for moving a fabric workpiece along a folding and stitching path, sewing machine 6, thread clipping apparatus 8, workpiece removal apparatus 10 and workpiece receiving platform 12.

Workpiece support table 2 includes a broad work-supporting surface 14 supported in a conventional manner by a plurality of legs. Both the workpiece transport 4, the sewing machine 6 and the thread clipper 8 are supported by other portions of this table 2.

The sewing machine 6 used in this apparatus may suitably be a Union Special Model 56500 driven by electric motor 16 through suitable belting arrangement. Operation of this sewing machine 6 may be controlled by the foot pedal 18 and presser foot lift pedal 20 in a conventional and well-known manner.

Workpiece transport 4, which moves a workpiece along the hem folding and stitching path and through the thread clipper is of the general nature of a power driven, endless rubber belt resiliently urged toward the supporting surface 14 of the table 2 and into transportably gripping engagement with fabric workpieces 48 interposed therebetween, and is illustrated in the sectional view of FIG. 3. At the longitudinal extremities of this transport mechanism are provided two sprockets 22 and 24 which support and engage the teeth of the conveying belt 26, which is suitably of the nature of a flexible rubberized timing belt. Portions of the supporting frame for the transport mechanism have been omitted for clarity, the right-hand end of this mechanism being supported by attachment to the sewing machine 6, and the left-hand end being supported by C-shaped bracket 28, which is fastened to the table 2 in a conventional manner. A long, leaf-like backing member 30, attached at its opposite extremity to frame portions of the transport 4, provides for a generally uniform pressure on the belt 26 toward the surface 14 of the table 2 along most of the length of travel of the belt. A plurality of resilient spring members 32 extend between transport frame member 34 and the backing member 30 to provide resilient support to that member 30 along its length. A suitable dust cover 36 provides a safety enclosure for the workings of this transport mechanism while leaving the lower portion open for engagement with workpieces to be transported thereby. The right-hand sprocket 24 of the transport is driven by a shaft 38 from gearbox 40. The input power from this gearbox 40 is from belt 42, which in turn receives its driving power from the electric motor 16 via a belt 44 and the dual pulley 46 attached to the sewing machine 6. Thus, the sewing machine 6 and transport conveyor 4 are driven together to provide the desired synchronization between the feeding rate of transport 4 and the feed of the oscillating advancing foot of the sewing machine 6. The gearbox 40 provides for selective adjustment of the output shaft speed relative to the input speed for adjustment of the transport feeding rate.

In operation, the machine operator inserts the pieces 48 of the fabric to be hemmed into the grip of transport 4. For purposes of illustration, such fabric workpieces 48 are shown as pieces such as are used to make the rear patch pockets of trousers, such as jeans. Such pieces will customarily be provided with a straight edge 50 which is to be folded and hemmed. The fabric piece 48 is positioned and aligned by the operator by urging the straight edge 50 against the guide 52, which is fastened to table 2, as the piece 48 is brought into engagement with the belt 26 of the transport 4. Once the fabric piece 48 is engaged by the belt 26, it is transported by the movement of that belt along a predetermined stitching path, as indicated by the phantom line representation of the fabric pieces in FIGS. 1 and 2. Shortly after engagement by the belt 26, the edge 50 of the pocket is brought into engagement with the folding element 54, which is attached to table 2. This folding element 54 is of conventional configuration and is illustrated on a larger scale in FIG. 4. Folding element 54 serves to roll the edge of the fabric piece 48 under and then pinch it flat to form the hem to be stitched. Upon exit from the folding member 54, the fabric piece 48 is brought under the presser foot and stitching mechanism 58 of the sewing machine 6, whereupon the hem is stitched, with single row or plural rows of stitching, as desired.

During the transport of the fabric pieces 48 along the stitching path which extends through the stitching mechanism 58 and parallel to the transport 4, the transport 4 which grippingly engages a portion of each fabric piece, moves the fabric continuously and smoothly along the stitching path whenever the motor 16 is running to drive the transport and the sewing machine. As is well known, the advancing foot of the sewing machine moves in an oscillatory manner such that the portion of the fabric passing through the presser foot of the sewing machine is moved between each stitch but is stationary while the sewing needle is being inserted therethrough. It has been found in this invention that by placing the transporting conveyor 4 parallel to the stitching path and a predetermined distance away from that path, the elasticity of the fabric compensates for the difference between the continuous movement of the gripping belt 26 and the intermittent movement of the fabric through the stitching apparatus 58 of the sewing machine and permits much greater sewing and transport speeds. The distance between the conveyor belt 26 and the stitching mechanism is easily ascertainable and may vary depending upon the stiffness of the fabric being sewn.

After the fabric pieces leave the sewing machine, a chain of stitches trail from the sewing needle to the trailing edge of the fabric piece 48. It is desirable that the individual hemmed fabric piece 48 be separated from both preceding and following pieces by severing the stitch chain. Accordingly, in the combination of this invention, is provided a thread cutter suitably of the type disclosed in Patent Application Ser. No. 849,076 filed Nov. 7, 1977 in the name of Hubert Blessing and Ted Michael Ray and assigned to the assignee of this invention. In this thread cutter, a vacuum head 56 is positioned a few inches away from the sewing machine needle and presser foot assembly 58, and is positioned to receive a fabric piece 48 after it has been stitched. The vacuum head is positioned so that a trailing thread chain from the sewing operation will drop down into the depressed channel 60 of the head 56 under the influence of a reduced air pressure therein. This reduced air pressure is provided at the head 56 through vacuum tube 62 and is produced by conventional vacuum pump 64, such as a shop vacuum cleaner.

Figure 6:
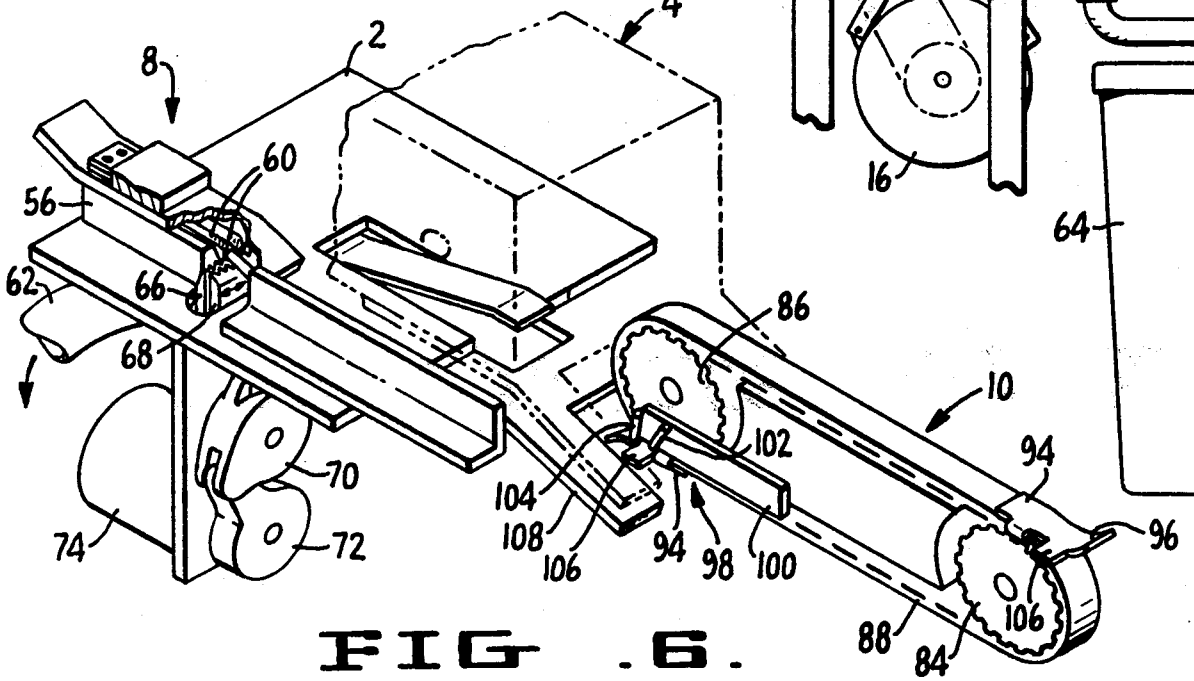
FIG. 6 is a fragmentary perspective view of the thread clipping and workpiece removal apparatus of this invention.

Immediately adjacent the end of the channels 60 distal the sewing machine 6 and its presser foot and stitching assembly 58 are provided a pair of conventional thread shearing elements 66 and 68. These thread shearing elements suitably are conventional powered shears with cutting element 68 reciprocated back and forth, as shown by the arrow in FIG. 6, immediately against the stationary element 66. Reciprocal motion for the element 68 may be provided by crank 70 and eccentric 72 operably connected to an electric motor 74 and to each other and to the element 68 in a manner to provide the desired rocking motion of the element 68.

The upper extremities of the thread cutting elements 66 and 68 preferably are positioned with their upper extremities even with or slightly below the upper level of the adjacent end of vacuum head 56 so that a fabric piece 48 transported past the thread clipper will ride over the cutting elements 66 and 68 while the thread chain, drawn down into the grooves 60, will be captured and severed by the cutting elements.

Once the thread chain tying one fabric piece 48 to the next has been severed, it is desirable to remove that fabric piece from the stitching path and stack it in some receiving area for subsequent removal and use. Since fabric workpieces 48 being fed along the stitching path through the sewing machine and thread clipper may be randomly spaced dependent upon the initial feeding by the operator, it is desirable that this workpiece removal mechanism be operable upon demand, whenever a workpiece is presented to it from the thread clipper 8. Such a removal mechanism is generally indicated by the reference numeral 10. This removal mechanism is positioned just beyond the end of the transport mechanism 4, which conveys the fabric pieces 48 from their point of initial insertion into the stitching path, through the stitching mechanism of the sewing machine 6 and then through and beyond the thread clipper 8. This removal mechanism suitably may be such as disclosed in my Patent Application Ser. No. 867,811 filed Jan. 9, 1978, entitled "Gripper Belt Transfer" and assigned to the assignee of this invention. Removal mechanism 10 may include a receiving surface 76 in the form of a circular table 12 rotatably supported upon upright 78 and driven by an electric motor (not shown) and drive wheel 80 for slow rotation about the axis defined by that upright 78.

Above the rotary table 12, a support frame 82 for the removal mechanism may also be supported by the upright 78. Attached adjacent the outer end of support 82 are sprocket wheels 84 and 86, about which is entrained a resilient, continuous, low mass belt 88 having teeth correspondingly engaging the recesses in the sprockets 84 and 86. Sprocket 84 is driven, via belt 90, by switch-actuated motor 92, which may suitably be a synchronous stepping motor. Onto belt 88 may be crimped one or more grippers 94, which include a trailing finger portion 96 bent so as normally to press inwardly against the belt when the gripper bearing portion of the belt is pulled straight, to deform the belt from its natural, otherwise straight configuration. When the gripper 94 passes around the curvature of one of the sprocket wheels 84 or 86, the belt 88 arcs away from this bent finger portion 96 so that space is provided between the bent finger portion 96 and the belt 88. When this space is created, a fabric workpiece can be either inserted or released from engagement between the gripper 94 and the belt 88.

Adjacent sprocket 86, which is proximal the thread clipper 8, is positioned the photo-optic sensor switch assembly 98, which serves to operate the motor 92 to remove on demand a fabric workpiece presented from the thread clipper 8. This assembly 98 includes mounting bracket 100, which is attached to support arm 82 and which carries, adjacent the sprocket 86, a light source 102 and a photo cell 104. As may be seen most clearly in FIG. 6, each gripper 94 is provided with a laterally projecting tab 106 extending adjacent the bent finger portion 96. The surface of this tab 106, which faces inwardly of the track of movement of the belt 88, is provided with a finish which is substantially reflective of light incident upon it. Light source 102 and photo cell 104 are positioned on their bracket 100 such that, when a gripper 94 is in a fabric workpiece receiving position adjacent the lowermost portion of sprocket 86, the tab 106 of that gripper 94 will be positioned to reflect the light from source 102 into photo cell 104. The photo-optic sensor switch assembly 98 is connected to a conventional motor control (not shown) which supplies power to the motor 92. This photo-optic sensor switch assembly 98, in combination with the motor control, is the equivalent of a normally electrically closed switch which becomes electrically open when light from source 102 is reflected from the gripper tab 106 back into photo cell 104 to provide an appropriate output signal from that photo cell. Thus, the motor 92 will be energized by the photo-optic sensor switch assembly 98 at any time that reflecting surface of the tab 106 is not available to reflect such energy efficiently back into the photo cell 104. During all such times as that energy is not available for reflection back into the photo cell 104, the motor 92 will be running, driving the gripper belt 88 around its path.

The manner of operation of the gripper belt drive may suitably be as follows. When the motor 92 has been energized, it will run until one of the grippers 94 is in such a position that its tab 106 reflects light from source 102 into sensor 104, thus deenergizing the motor and stopping the belt with the gripper 94 adjacent the lowermost portion of sprocket 86. In this condition, the curvature of the belt 88 around sprocket 86 will cause the belt to arc away from the finger portion 96 so that space is provided between that portion 96 and the belt 88. When this space is created, a fabric workpiece 48 can be either inserted or released from engagement between the gripper 94 and the belt 88.

When a workpiece is delivered from thread clipper 8 by transport 4, it slides down ramp 108 into the space between the trailing finger portion 96 of the gripper 94 and the belt 88. Since the reflective tab 106 of gripper 94 forms a portion of the bent finger 96, a fabric piece 48, such as one of the pocket pieces illustrated in phantom in FIGS. 1 and 2, inserted into that space will overlie and thus cover the reflective surface 106. Such fabric piece is substantially less reflective than the surface of the tab 106 and thus effects energization of the motor 92 which drives the belt 88 and thus the gripper 94 around its path of travel. As indicated above, the motor 92 remains energized at any time that the reflective surface of a tab 106 is not positioned beneath the light source 102 and sensor 104 to deenergize the motor. Thus, the motor 92 will continue to run until a gripper 94 has been brought into that workpiece receiving position again.

In this preferred embodiment, two grippers 94 are provided on the belt, although a single gripper or other plurality of grippers may be provided as desired. In this embodiment, with two grippers, the motor 92 will thus be energized upon each actuation to drive gripper belt through one half of its total path of travel. When the gripper carrying the fabric workpiece 48, as illustrated in FIG. 5, begins its travel around sprocket 84, the belt 88 will again arc away from engagement with the bent finger portion 96 of the gripper, thus releasing the grip upon the workpiece 48 carried there within and permitting it to fall onto the receiving surface 76 of the rotating support table 12. Since table 12 is being rotatably driven, as described above, the sequentially transported and released workpieces will be stacked in shingle fashion onto the surface 76 for subsequent removal and use in other garment fabricating operations. In this preferred embodiment, the response of the transport assembly upon energization of the motor 92 by the photo-optic sensor assembly 98 is so fast that the gripper can engage and transport a moving workpiece received from the thread clipper 8 with no appreciable loss and the velocity of movement of the workpiece, such that the transfer of the moving workpiece from the guide ramp 108 to the gripper belt and then onto the receiving surface 76 proceeds smoothly. Obviously, the speed of transport can be adjusted by various conventional means to meet the requirement of the operating environment.

By the combination of the above described invention, individual fabric workpieces may be automatically hemmed and stacked for subsequent use with no operator intervention from the time that a workpiece is first fed into the transport conveyor 4, thus enabling a significant advance in the automation of the manufacture of fabric items such as clothing.

While a particularly preferred embodiment of this invention has been described above in detail, it is to be understood that this embodiment is illustrative only of the principles of this invention and is not to be limitative thereof. Such numerous equivalent, modifications and variations of the described structure will become readily apparent to those skilled in the art, the scope of this invention is to be limited solely by the claims appended hereto.

What is claimed is:

1. Apparatus for providing individual hemmed pieces of fabric, comprising in combination means for hemming each said fabric piece, said hemming means comprising means for folding an edge of each said fabric piece whereby a hem is formed for stitching, a sewing machine for stitching said hem with said stitching forming a stitching chain between successive said fabric pieces, said sewing machine including both a stitching mecahnism and means positioned along a predetermined stitching path for feeding each said fabric piece step-wise along said stitching path through said stitching mechanism, and means spaced from said stitching path for grippingly engaging a portion of said fabric piece spaced from said hem and moving said fabric piece continuously and smoothly along a path extending generally parallel to said stitching path from a point ahead of said stitching mechanism to a point beyond said stitching mechanism;

a thread cutter positioned along said stitching path at a point subsequent to said stitching mechanism for mechanically severing a stitch chain trailing from said fabric workpiece in which the hem has been stitched; and means for removing each said hemmed fabric piece from said stitching path after said stitch chain has been severed, said removing means including transporting means for releasably gripping and transporting a fabric piece from said stitching path to a receiving position where said fabric piece is released, and sensor means for sensing the presence of a fabric piece in position for removal and then activating the gripping and transporting means.

2. The apparatus of claim 1 wherein said removing transport means comprises a pair of spaced apart wheels, a continuous drive belt of resilient, low mass material entrained about the wheels, switch activated motor means for intermittently driving the wheels and the belt, and at least one gripper finger clamped to the belt for clasping the edge of said fabric piece against the belt, the gripper finger being bent inwardly toward the belt to deform the belt from its natural configuration.

3. The apparatus of claim 2 further comprising a plurality of said gripper fingers clamped to said belt at spaced apart locations.

4. The apparatus of claim 1 further comprising a horizontal support surface for receiving fabric pieces carried and released by said gripper finger and means for rotating said support surface about a vertical axis.

* * * * *